United States Patent [19]

Hayes

[11] 4,325,690

[45] Apr. 20, 1982

[54] GAS PILOT ASSEMBLY FOR UNIVERSAL APPLICATION AND METHOD OF MAKING SAME

[75] Inventor: Thomas E. Hayes, Goshen, Ind.

[73] Assignee: Johnson Controls, Inc., Milwaukee, Wis.

[21] Appl. No.: 76,519

[22] Filed: Sep. 17, 1979

[51] Int. Cl.[3] ..... F23H 5/00; F23Q 7/06; F23Q 9/00

[52] U.S. Cl. ..... 431/78; 431/66; 431/258; 431/284

[58] Field of Search ..... 431/78, 66, 59, 24, 431/284, 258

[56] References Cited

U.S. PATENT DOCUMENTS

| | | | |
|---|---|---|---|
| 2,074,637 | 3/1937 | Ballentine | 431/78 |
| 2,589,804 | 3/1952 | Harris et al. | 431/78 |
| 2,596,729 | 5/1952 | See | 431/78 |
| 2,660,645 | 11/1953 | Deubel | 431/78 |
| 2,814,339 | 11/1957 | Aubert | 431/78 |
| 2,996,113 | 8/1961 | Williams | 431/78 |

*Primary Examiner*—Samuel Scott
*Assistant Examiner*—Wesley S. Ratliff, Jr.
*Attorney, Agent, or Firm*—Emrich, Root, Lee, Brown & Hill

[57] ABSTRACT

A pilot assembly includes a base having a cylindrical side wall which holds an electrode subassembly and glass preforms in place for fusing the glass to secure the electrode subassembly to the base. Prior to fusing, a spark electrode is assembled by inserting it into a metal clip receptacle held in a ceramic insulator body forming a part of the electrode subassembly. A pilot tip and orifice subassembly are secured to the base. Fusion of the glass and brazing of the metal including the high tension clip to bring it to spring temper for connection to a plugged wire are accomplished in a single step of heating. The pilot tip includes a locator member which holds the spark electrode in place during fusing and establishes the spark gap. It is removed after fusing. A connecting flange of a bracket is then positioned relative to the side wall of the base to achieve a desired angular disposition, axial orientation and height adjustment of the base relative to the bracket; and the bracket is welded to the side wall of the base. Thus, the same structural elements can be used for many different models of a gas pilot assembly without the need for special parts or process steps for manufacture.

9 Claims, 17 Drawing Figures

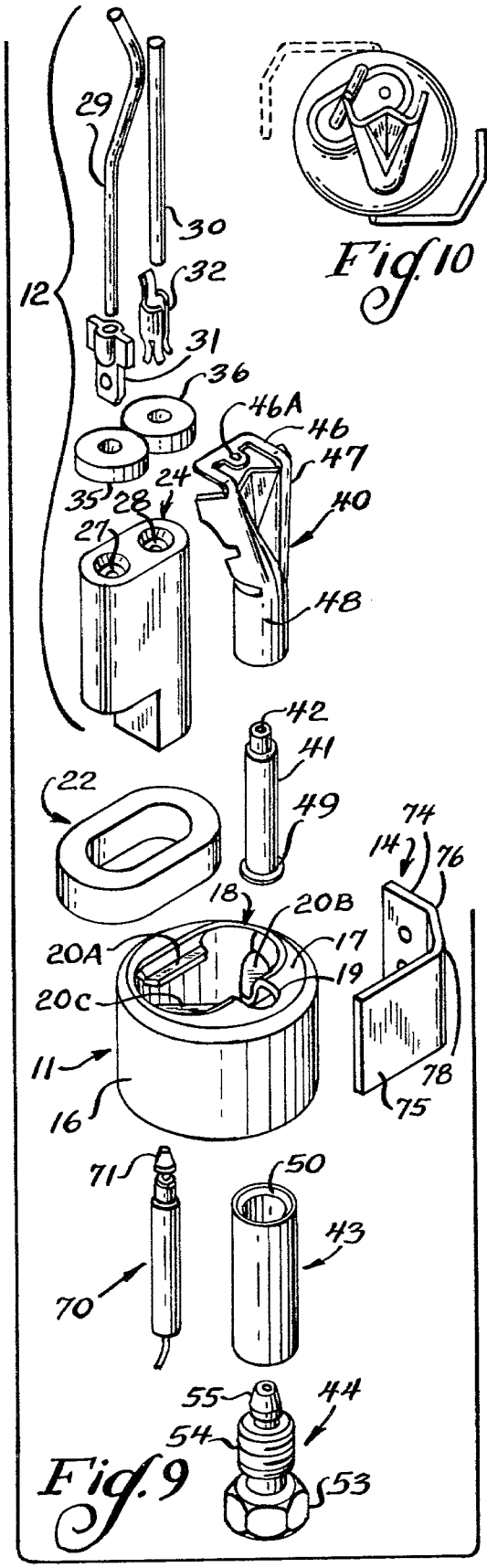
Fig. 9
Fig. 10
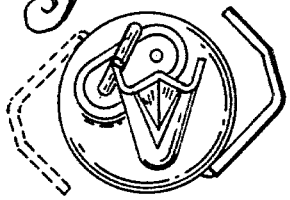
Fig. 11
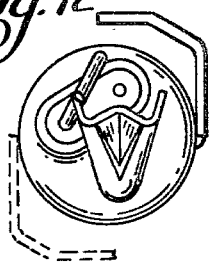
Fig. 12
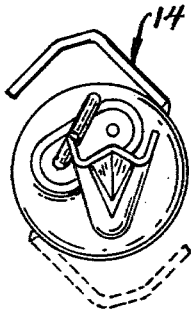
Fig. 13
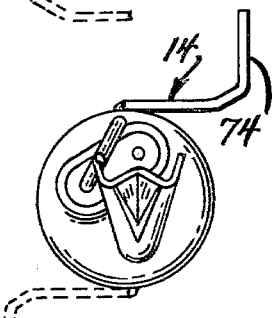
Fig. 14
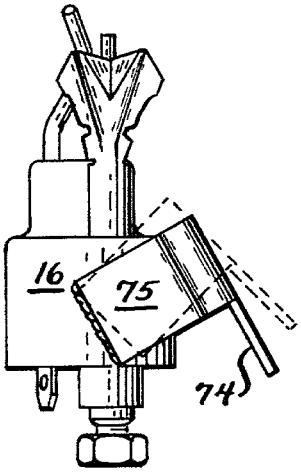
Fig. 15
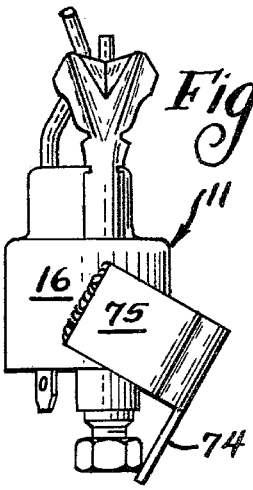
Fig. 16
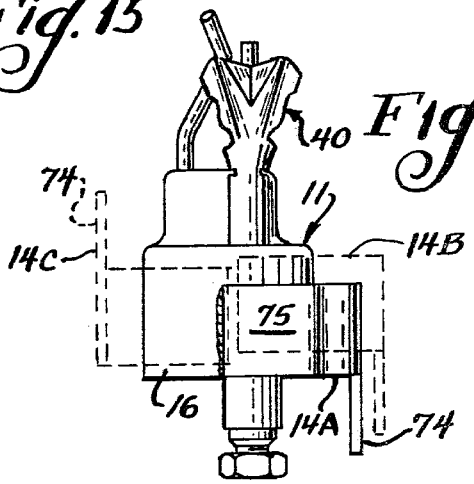
Fig. 17

GAS PILOT ASSEMBLY FOR UNIVERSAL APPLICATION AND METHOD OF MAKING SAME

BACKGROUND AND SUMMARY

The present invention relates to a pilot assembly of the type used in gas-fired appliances, particularly appliances such as furnaces and hot water heaters using natural gas as a source of fuel; and it also relates to a method manufacturing a gas pilot assembly of this type.

Gas pilots currently in use are not of the type previously used wherein the pilot burned continuously, referred to as a standing pilot. Rather, current technology employs ignition control circuits which inhibit the flow of gas to the pilot until a call for heat signal is received. At this time, a valve is opened to supply gas to the pilot, and an electrical signal of high frequency and voltage energizes a spark electrode strategically placed relative to gas emitted from the pilot tip for igniting the pilot flame. Fuel is then supplied to the main burner, and the flame is transferred from the gas pilot to the main burner. The gas pilot may also include a flame sensing electrode from which an electrical signal is generated in the presence of a flame. The flame sensing signal may either be a DC signal generated from rectification of an AC signal supplied to the flame sensing electrode, or it may be a conventional DC signal representative of reduced impedance in the presence of ionized gas.

Obviously, the dependability and reliability of a gas pilot are extremely important from the standpoint of safety. Extensive testing is performed with respect to the placement of a pilot relative to the main burner, and typically, a manufacturer's specifications on a pilot will vary from model to model for furnaces and other gas-fired appliances. From the viewpoint of a manufacturer of gas pilots, the large number of, and rather rigid specifications for, gas pilot assemblies create problems in manufacturing, inventory and so on, both for original equipment use and for replacement or retrofitting existing equipment with the new gas pilot.

As an example, a manufacturer may have hundreds of models and styles, when considering variations, for a gas pilot which performs basically the same functions.

The present invention, therefore, is intended to provide a gas pilot assembly which is universal in application in the sense that the same basic structural elements can be arranged and assembled during the manufacturing operation to meet the various specifications for different models and manufacturers of gas appliances. The invention is also directed to a method of manufacturing a universal gas pilot.

The pilot assembly includes a base in the form of an inverted cup having a cylindrical side wall. The cup is die formed from metal, and it holds an electrode subassembly as well as a tip subassembly which includes a pilot tip and orifice mechanically attached to the cup. The electrodes are held by a ceramic body, and the spark electrode is positioned relative to the tip by a locator member formed as an appendage on the tip.

The spark electrode is assembled to a clip member preferably formed from stainless steel which, upon brazing, will form a spring clip receptacle for receiving an end-plugged high tension wire. Glass preforms are placed on the cup surrounding the ceramic body, and additional preforms are placed on the electrodes above the ceramic body.

The assembly is then subjected to heat in a furnace, and this single step both brazes the metal and fuses the glass to provide a rigid assembly. One of the features of the invention is that both electrodes are rigidly secured in place relative to the cup, the pilot tip, and their associated connecting wires so that electrical shorts or open circuits become highly unlikely even though the assembly may be subjected to severe conditions.

Following the heating step, a mounting bracket having a vertically elongated mounting plate and a laterally extending connecting flange is then assembled to the side wall of the cup base and spot-welded to it, and the locator member is cut off the tip to provide the desired spark gap.

In the illustrated embodiment, the mounting plate and the connecting flange of the mounting bracket are disposed at right angles and spaced such that the connecting flange can be secured to the cylindrical side wall of the cup base at any rotational angle of the cup. Further, the axis of the cylindrical side wall of the cup can be angularly disposed, within limits, relative to the plane of the mounting plate of the mounting bracket. Still further, the mounting bracket may be assembled to the cup in either of two vertical orientations so that the mounting plate may extend above the cup or beneath it, and it may be continuously adjusted axially relative to the cup in either of these positions. There is thus provided a very broad range of orientations of the pilot relative to the mounting bracket so as to meet a large number of specifications for different manufacturers relative to placement of the pilot assembly in an appliance by means of the cooperative relationship between the structure of the mounting bracket and the structure of the pilot assembly.

Other features and advantages of the present invention will be apparent to persons skilled in the art from the following detailed description of a preferred embodiment accompanied by the attached drawing wherein identical reference numerals will refer to like parts in the various views.

THE DRAWING

FIG. 9 is an upper perspective view of the assembly of FIG. 1 with the elements in exploded relation;

FIGS. 10–14 are top views of the assembly of FIG. 1 illustrating various dispositions of the mounting bracket relative to the cup base prior to welding the bracket; and FIGS. 15–17 are vertical views of the assembly similar to FIG. 2 and illustrating various dispositions of the mounting bracket relative to the cup base.

DETAILED DESCRIPTION

Figure 1:
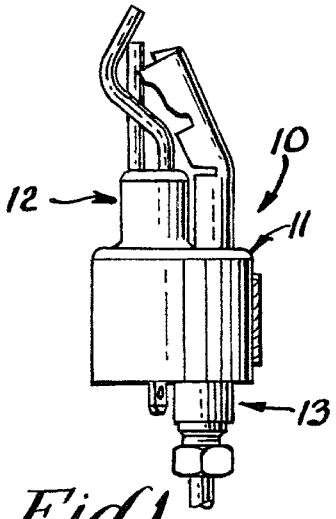
FIG. 1 is an elevational view of a gas pilot assembly incorporating the present invention.
Figure 2:
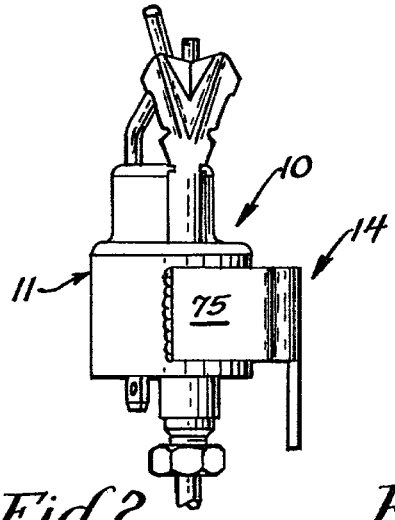
FIG. 2 is a view similar to FIG. 1 with the assembly rotated clockwise (when viewed from the top) 90°.
Figure 3:
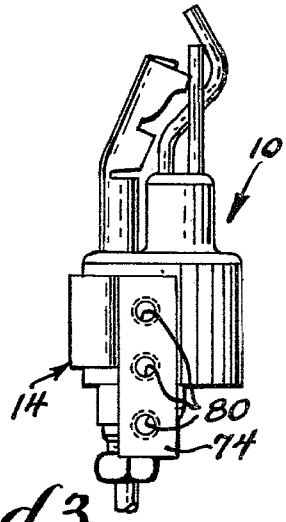
FIG. 3 is a view similar to FIG. 1 with the assembly rotated 180° about its axis.

Referring first to FIGS. 1–3, a pilot assembly incorporating and manufactured in accordance with the present invention is generally designated 10. The principal elements of the assembly are a base generally designated 11 of inverted cup shape, an electrode subassembly generally designated 12, and an orifice and tip subassembly generally designated 13. A mounting bracket generally designated 14 is welded to the cup base 11 as will be further described below.

As best seen in FIG. 9, the cup 11, which may be die formed from metal, includes a cylindrical side wall 16 and a top 17 which defines an oval shaped larger aperture generally designated 18 for receiving the electrode assembly 12, as well as a smaller cutout 19 through which the orifice and tip assembly extend. As will be further described, the orifice and tip assembly are mechanically fastened to the portion of the top wall 17 surrounding the cutout 19.

The cup 16 includes three support flanges 20A, 20B and 20C for centering the electrode assembly within the larger aperture 18 and for supporting the fused glass of an oval-shaped glass preform generally designated 22.

Still referring to FIG. 9, the electrode assembly includes a ceramic body generally designated 24 having an oval cross section and adapted to be received in the large opening 18 of the cup 11 and to abut the flanges 20A–20C. Central openings or bores 27, 28 are formed longitudinally of the ceramic body for receiving respectively a flame-sensing electrode 29 and a spark electrode 30. The upper portions of the bores 27, 28 are enlarged, as best seen in FIG. 9, to receive fused glass, as will become apparent, for securing the upper portions of the electrodes to the ceramic body 24. An electrical clip 31 with a flat terminal portion is welded to the flame-sensing electrode 29, and a spring clip 32 which may be made from stainless steel is similarly attached to the spark electrode 30. The clip 32 will achieve spring temper when subjected to the heat of the furnace for releasably receiving a plugged wire or high tension lead, as will be described.

Figure 6:
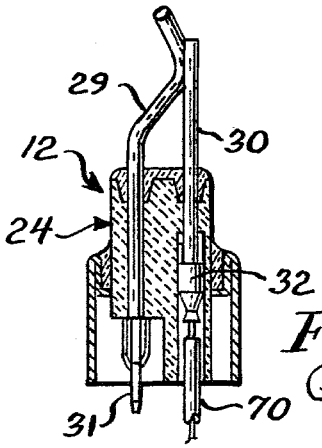
FIG. 6 is a vertical cross sectional view taken through the sight lines 6—6 of FIG. 4.
Figure 5:
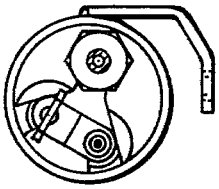
FIG. 5 is a bottom view of the assembly as oriented in FIG. 2.
Figure 7:
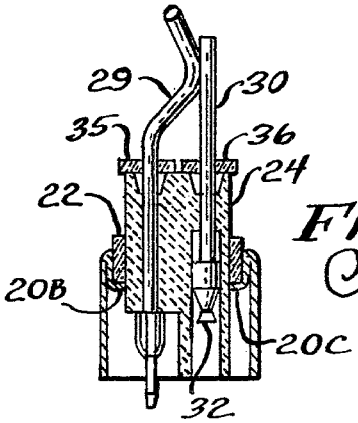
FIG. 7 is a view similar to FIG. 6 prior to fusion and before connecting the high tension wire to the spark electrode.

First and second annular shaped glass preforms 35, 36 are placed over the electrodes 29, 30 respectively adjacent the top of the ceramic body 24 when the electrode subassembly 12 is assembled to the cup 11. When the glass is fused, the preform 22 secures the electrode assembly 12 to thecup 11, and the preforms 35, 36 conform to the shape of the enlarged upper portions of the bores 27, 28 to secure the electrodes to the ceramic body. This will be understood by comparing FIG. 7 (prior to fusing) with FIG. 6 (after fusing).

Figure 4:
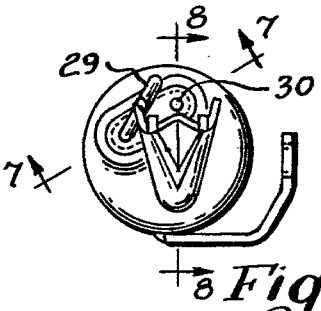
FIG. 4 is a top view of the assembly as oriented in FIG. 2.

Turning now to the pilot tip and orifice assembly 13, it includes a pilot tip generally designated 40, a barrel-shaped member 41 which has a reduced upper portion defining an orifice 42 of predetermined diameter, an internally threaded sleeve 43 and a threaded fitting 44. The tip 40 includes a shroud 47 which partially shields and deflects the pilot flame of gas emanating from the orifice 42, and against which the electrodes 29, 30 are spaced at predetermined distances or "gaps". An appendage or locator member 46 (FIG. 9) is formed integrally with the top of the tip 40, and it extends outwardly from it to receive the spark electrode 30 in an aperture 46A. The locator member 46 holds the spark electrode in place until it is secured by fused glass, and it also defines the distance between the shroud 47 and the top of the spark electrode so that the spark gap does not have to be set after fusing. The locator member is simply sheared off (see the remnants left after shearing in FIG. 4 only, for brevity).

Figure 8:
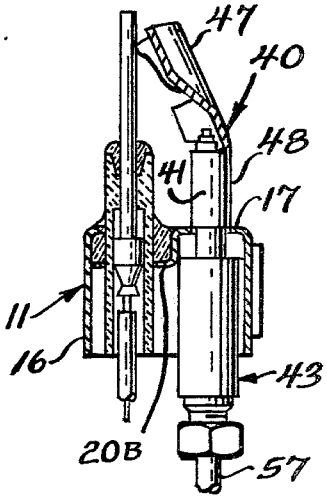
FIG. 8 is a vertical cross sectional view of the assembly taken through the sight lines 8—8 of FIG. 4.

The tip 40 also includes a lower clip portion 48 which fits about the barrel 41. The bottom edge of the clip portion 48 engages the top of the cup 11 about the edges of the cutout portion 19, as best seen in FIG. 8. The lower portion of the barrel 41 is flared at 49 for engaging the underside of a shoulder flange 50 formed on the upper interior portion of the sleeve 43 which is wedged into the cup 11 between the side wall 16 and the recessed portion of the cup which forms the support flanges 20B and 20C, as best illustrated in FIG. 8. The fitting 44 includes a nut 53, an exterior thread 54 and an upper tapered portion 55 which secures the flared end 49 of the barrel 41 against the shoulder 50 of the sleeve 43 when the fitting 44 is tightened into the interior threads of the barrel 43. The fitting 44 connects to a gas supply conduit such as that designated 57 in FIG. 8.

ASSEMBLY AND FUSING

The tip and orifice subassembly is mounted to the cup 11 in the manner just described—namely, by screwing the fitting 44 into the sleeve 43 to secure the barrel 41 which is placed through the cutout 19, and the tip 40 is forced over the upper end of the barrel 41 by means of the clip portion 48 until the bottom edge of the clip is forced against the surface 17 with the barrel wedged against the side wall 16 of the clip.

The electrode subassembly 12 is assembled to the cup 11 in the manner described with the spark electrode received in aperture 46A; and the ceramic body 24 is held in the desired position relative to the cup by any suitable means such as a jig. The pilot assembly is then passed through a furnace having a hydrogen atmosphere at 1800° F. This single step fuses the glass and brazes all of the metal parts. It brings the clip 32 of the spark electrode 30 to spring temper also, so that a high tension wire, such as that designated 70 in FIG. 9 and having a plugged end 71 (which may be a plug of the type known as a "rajah" plug), can be quickly assembled to it while insuring electrical continuity. When the glass fuses, the rings 35, 36 secure the electrodes 29, 30 to the ceramic body 24; and the larger preform 22 fuses the ceramic body to the cup, as will be appreciated by comparing FIG. 7 (prior to fusing) with FIG. 6 (after fusing). It will be observed that the glass preforms 35, 36 flow downwardly into the enlarged upper portions of the bores 27, 28 in the ceramic body 24.

MOUNTING BRACKET AND ASSEMBLY

As best seen in FIGS. 2, 3 and 9, the mounting bracket 14 includes a flat mounting plate 74 and a connecting or weld flange 75. The bracket may be stamped from sheet metal and formed with first and second bends 76, 78 so that the connecting flange 75 is generally perpendicular to the mounting plate 74. The plate 74 is vertically elongated and contains three tapped apertures designated 80 in FIG. 3 for receiving mounting screws (not shown). Normally, the center aperture and either the upper or lower tapped aperture are used for mounting so as to adjust the height of the pilot assembly relative to its mounting to a main burner.

The height of the mounting bracket 14 may be adjusted axially of the side wall 16 of the cup 11, as illustrated in FIG. 17 (compare positions 14A and 14B, for example) prior to welding the connecting flange 75 to the side wall 16, or the mounting bracket can be completely turned around to the position indicated in dashed line at 14C, providing still further height adjustment. In the first position, the mounting flange 74 extends away from the pilot tip 40; and in the second position (14C) the mounting flange 74 extends in the direction of the pilot tip 40 relative to the cup 11.

Referring to FIGS. 10–14, the mounting bracket is illustrated in various angular dispositions about the circumference of the cup 11 (diagonally opposite positions being indicated respectively in solid and dashed line). It is thus apparent that the pilot assembly can be rotated to any desired angular orientation relative to the mounting bracket. Further, as seen in FIG. 14, the bracket 14 can be turned around about a vertical axis so that the mounting plate 74 extends away from the pilot assembly, rather than about it as illustrated in FIGS. 10–13.

Still further, as seen in FIGS. 15 and 16, the mounting bracket can be oriented such that the axis of the cup 11 forms an angle with the plane of the mounting plate 74. Typically, this angle can be 20° in either direction, as can be seen by comparing FIGS. 15 and 16. The same angular orientation adjustment can be achieved whether the mounting flange 74 extends about the side wall of the cup or away from it, as seen in FIGS. 13 and 14 respectively.

When the cup and mounting bracket are assembled at the desired position, they are welded together. In final preparation, the rajah plug 71 is staked on the high tension wire 70 and inserted into the spring clip 32, and the locator member 46 is cut away. There is no need to separately set the gap between the spark electrode 30 and tip 40.

It will thus be appreciated that the structure of the present invention permits of a wide variation in the orientation of the pilot assembly relative to the mounting bracket, both in the rotational or angular orientation, the height adjustment of the pilot assembly relative to the mounting plate, and the angular disposition of the mounting plate relative to the axis of the pilot assembly. Further, the use of fused glass provides a rigid connection of the electrodes to the ceramic body 24, and of the electrode subassembly 12 to the base or cup 11.

It will also be appreciated that the assembly, fusing and brazing of the structure greatly simplify the manufacturing process and obviate the need for a separate setting of the spark gap.

Having thus disclosed in detail a preferred embodiment of the inventive apparatus and method, persons skilled in the art will be able to modify certain of the steps which have been disclosed and to substitute equivalent elements for those described while continuing to practice the principle of the invention; and it is, therefore, intended that all such substitutions and modifications be covered as they are embraced within the spirit and scope of the appended claims.

What is claimed is:

1. A gas pilot assembly comprising: a base having a curved side wall portion and defining an opening in a surface transverse of said side wall; an electrode subassembly received in said opening of said base and including a ceramic body, at least one electrode received in said body and secured thereto by fused glass, and a connector on said electrode; fused glass means connecting said ceramic body to said base about said opening; a pilot tip and orifice subassembly secured to said base and including a tip extending upwardly of said base adjacent said electrode, means defining an orifice connected to said tip, and means for connecting a source conduit to said orifice-defining means; and a mounting bracket including a mounting plate and a flat connecting flange, said flange being welded to the exterior of said curved side wall of said base and characterized in that the angular orientation and axial displacement of said curved wall relative to said connecting flange and the angular orientation of the axis of said curved wall and said mounting bracket may be adjusted over a continuous range prior to welding said connecting flange to said side wall portion.

2. The apparatus of claim 1 wherein said curved wall of said base is cylindrical and defines a generally vertical axis, the included acute angle between said axis and said mounting flange of said bracket being less than about 20°.

3. The apparatus of claim 2 wherein said base further defines a horizontal top portion defining said opening adapted to receive said ceramic body and including inwardly spaced flanges beneath said top for supporting flowing glass during fusion, and a cutout communicating with said opening, said pilot tip and orifice subassembly being connected to said base adjacent said cutout portion and extending therethrough.

4. The apparatus of claim 1 wherein said electrode subassembly comprises a flame sensing electrode and a spark electrode supported separately by said ceramic body; a first electrical clip welded to said flame sensing electrode and a second electrical spring clip connected to the base of said spark electrode and spring tempered, said apparatus further including a high tension wire adapted to excite said spark electrode and defining a plugged end for securing to said spring clip of said spark electrode.

5. The apparatus of claim 1 wherein said mounting bracket includes a vertically elongated flat mounting plate defining a series of vertically spaced tapped apertures and said flat connecting flange is welded to said curved surface of said base.

6. The apparatus of claim 5 characterized in that said mounting plate and said connecting flange of said bracket are transverse of each other.

7. A gas pilot assembly comprising: a base having a curved side wall portion and defining an opening in a surface transverse of said side wall; an electrode subassembly received in said opening of said base and including a ceramic body, at least one electrode received in said body, and a connector on said electrode; fusible glass means for securing said ceramic body to said base about said opening and for securing said electrode to said body; a pilot tip and orifice subassembly secured to said base and including a tip extending upwardly of said base adjacent said electrode, a locator member extending from said tip and engaging said electrode for establishing a gap between said tip and said electrode, said locator member being severable from said tip after said glass means are fused, means defining an orifice connected to said tip, and means for connecting a source conduit to said orifice-defining means; and a mounting bracket including a mounting plate and a connecting flange, said flange being welded to said curved side wall of said base.

8. A method of assembling a gas pilot structure to a predetermined specification comprising: providing a cup-shaped base defining an upper aperture and a cutout aperture and having a generally cylindrical side wall; assembling an electrode subassembly including an electrode in a ceramic body to said cup with said ceramic body extending through said upper aperture; placing a first glass preform between said ceramic body and said cup about said upper aperture and a second glass preform about said electrode; providing a clip member attached to the base of said electrode; assembling a pilot tip and orifice subassembly to said base about said cutout aperture; heating said assembled elements to simultaneously fuse said glass preforms and to braze the metal parts thereof, said first glass preform securing said electrode subassembly to said base, said second glass preform rigidly attaching said electrode to said ceramic body; then orienting a mounting bracket having a vertically elongated mounting plate and a flat connecting flange with predetermined relationships between the angular disposition of said cup and said flange, the angular disposition between the axis of said cup and said mounting plate, and the axial location of said mounting plate relative to said side wall of said cup and then welding said connecting flange to the side wall of said cup.

9. The method of claim 8 further comprising the steps of spacing said electrode relative to said pilot tip prior to said step of heating by placing said electrode in an aperture on a locator appendage of the top of said tip; and removing said appendage after said step of heating whereby the gap between said electrode and tip does not have to be separately set.

* * * * *